US012497751B2

(12) United States Patent
Miyazaki et al.

(10) Patent No.: US 12,497,751 B2
(45) Date of Patent: Dec. 16, 2025

(54) DRILLING POSITION DETERMINATION SYSTEM, DRILLING CONTROL SYSTEM, AND WORK MACHINE

(71) Applicant: KOBELCO CONSTRUCTION MACHINERY CO., LTD., Hiroshima (JP)

(72) Inventors: Ryunosuke Miyazaki, Hiroshima (JP); Daisuke Noda, Hiroshima (JP); Koji Yamashita, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 342 days.

(21) Appl. No.: 18/246,266

(22) PCT Filed: Sep. 13, 2021

(86) PCT No.: PCT/JP2021/033480
§ 371 (c)(1),
(2) Date: Mar. 22, 2023

(87) PCT Pub. No.: WO2022/070852
PCT Pub. Date: Apr. 7, 2022

(65) Prior Publication Data

US 2023/0358015 A1 Nov. 9, 2023

(30) Foreign Application Priority Data

Oct. 2, 2020 (JP) ..... 2020-168015

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/123* (2013.01); *E02F 9/265* (2013.01)

(58) Field of Classification Search
CPC ... E02F 3/435; E02F 3/32; E02F 9/123; E02F 9/265
See application file for complete search history.

(56) References Cited

U.S. PATENT DOCUMENTS

2013/0158785 A1 6/2013 Fukano et al.
2014/0099178 A1* 4/2014 Nomura ..... E02F 9/26 414/685
(Continued)

FOREIGN PATENT DOCUMENTS

JP 54-123202 A 9/1979
JP 2000-291076 A 10/2000
(Continued)

OTHER PUBLICATIONS

Supplemental European Search Report issued in European application 21875174.3 on Feb. 14, 2024, 7 pgs.
(Continued)

*Primary Examiner* — Hussein Elchanti
(74) *Attorney, Agent, or Firm* — Oblon, McClelland, Maier & Neustadt, L.L.P.

(57) ABSTRACT

An excavation position determination system achieves appropriate determination of an excavation start position in accordance with a shape or contour of an excavation target. The excavation position determination system includes: a photographing device that photographs an excavation target having a mountain shape and a bucket included in a working machine; a start position determinator that determines an excavation start position of the bucket to the excavation target. The start position determinator determines, on the basis of detected data from the photographing device, a
(Continued)

position of the bucket where the bucket is not wholly hidden by the excavation target but a part of the excavation target and a part of the bucket overlap each other when the bucket is seen from a machine body of the working machine as the excavation start position.

11 Claims, 8 Drawing Sheets

(51) Int. Cl.
*E02F 9/12* (2006.01)
*E02F 9/26* (2006.01)

(56) References Cited

U.S. PATENT DOCUMENTS

2018/0003152 A1 1/2018 Piskorz et al.
2019/0024346 A1 1/2019 Nishi
2019/0066323 A1* 2/2019 Li ..... G06F 18/22
2019/0218744 A1 7/2019 Izumikawa
2020/0141091 A1 5/2020 Narikawa et al.
2020/0242829 A1* 7/2020 Cheng ..... E02F 9/261
2020/0349760 A1* 11/2020 Hendron ..... E02F 9/261
2020/0399863 A1* 12/2020 Aizawa ..... G06Q 10/10
2020/0407949 A1 12/2020 Aizawa et al.
2021/0230841 A1* 7/2021 Kurosawa ..... E02F 9/261
2021/0254312 A1 8/2021 Oi et al.

FOREIGN PATENT DOCUMENTS

JP 2017-186901 A 10/2017
JP 2019-52515 A 4/2019
JP 2019-203285 A 11/2019
JP 2020-20153 A 2/2020
JP 2020-33836 A 3/2020
WO WO 2017/170900 A1 10/2017
WO WO 2018/062374 A1 4/2018

OTHER PUBLICATIONS

International Search Report Issued Nov. 22, 2021, in PCT/JP2021/033480, filed on Sep. 13, 2021, 3 pages.

* cited by examiner

DRILLING POSITION DETERMINATION SYSTEM, DRILLING CONTROL SYSTEM, AND WORK MACHINE

TECHNICAL FIELD

The present invention relates to a determination system for an excavation position to an excavation target having a mountain shape to be excavated by a working machine, relates to an excavation control system, and relates to the working machine.

BACKGROUND ART

For instance, Patent Literature 1 describes a conventional excavation control by a working machine. In Patent Literature 1, a boom angle, an arm angle, and a slewing angle are calculated so that a coordinate of an arm distal end of a hydraulic backhoe and each excavation position agree with each other. Further, an angle of each of a boom, an arm, and a vehicle body is controlled to agree with the corresponding calculated value. What is described is that deviation in excavation positions from each other in a slewing direction leads to easy and efficient automatic excavation of a division having a larger range than a bucket width.

CITATION LIST

Patent Literature

Patent Literature 1: Japanese Unexamined Patent Publication SHO 54-123202

Under the excavation control described in Patent Literature 1, the arm distal end is moved to reach a preset excavation position, and excavation is executed in determined order.

However, an excavation target has a shape or contour changing every moment in accordance with an excavation situation thereof. In this respect, the excavation control described in Patent Literature 1 fails to appropriately determine the excavation position in accordance with the shape or contour of the excavation target.

SUMMARY OF INVENTION

An object of the present invention is to provide an excavation position determination system that achieves appropriate determination of an excavation start position in accordance with a shape or contour of the excavation target.

An excavation position determination system according to the present invention is an excavation position determination system for use in a working machine including a machine body and a bucket movable relative to the machine body for excavating an excavation target having a mountain shape. The excavation position determination system includes: a photographing device that photographs the excavation target and the bucket; and a start position determinator that determines an excavation start position of the bucket to the excavation target. The start position determinator determines, on the basis of detected data from the photographing device, a position of the bucket where one part of the bucket is visible from the machine body and other part of the bucket that is different from the one part is hidden by the excavation target when the bucket is seen from the machine body as the excavation start position.

Further, the present invention provides an excavation control system including: the excavation position determination system described above; and a signal input section that inputs a drive instructive signal to the working machine to start an excavation operation for the excavation target by the bucket from the excavation start position determined by the start position determinator of the excavation position determination system.

In addition, the present invention provides a working machine including: a machine body; a bucket that is movable relative to the machine body; a drive section that drives the bucket; and the excavation control system described above. The signal input section inputs the drive instructive signal to the drive section to start the excavation operation for the excavation target by the bucket from the excavation start position determined by the start position determinator of the excavation position determination system.

DESCRIPTION OF EMBODIMENTS

Hereinafter, an embodiment of the present invention will be described with reference to the accompanying drawings. In the description below, a hydraulic excavator 1 is described as an example of a working machine.

Figure 1:
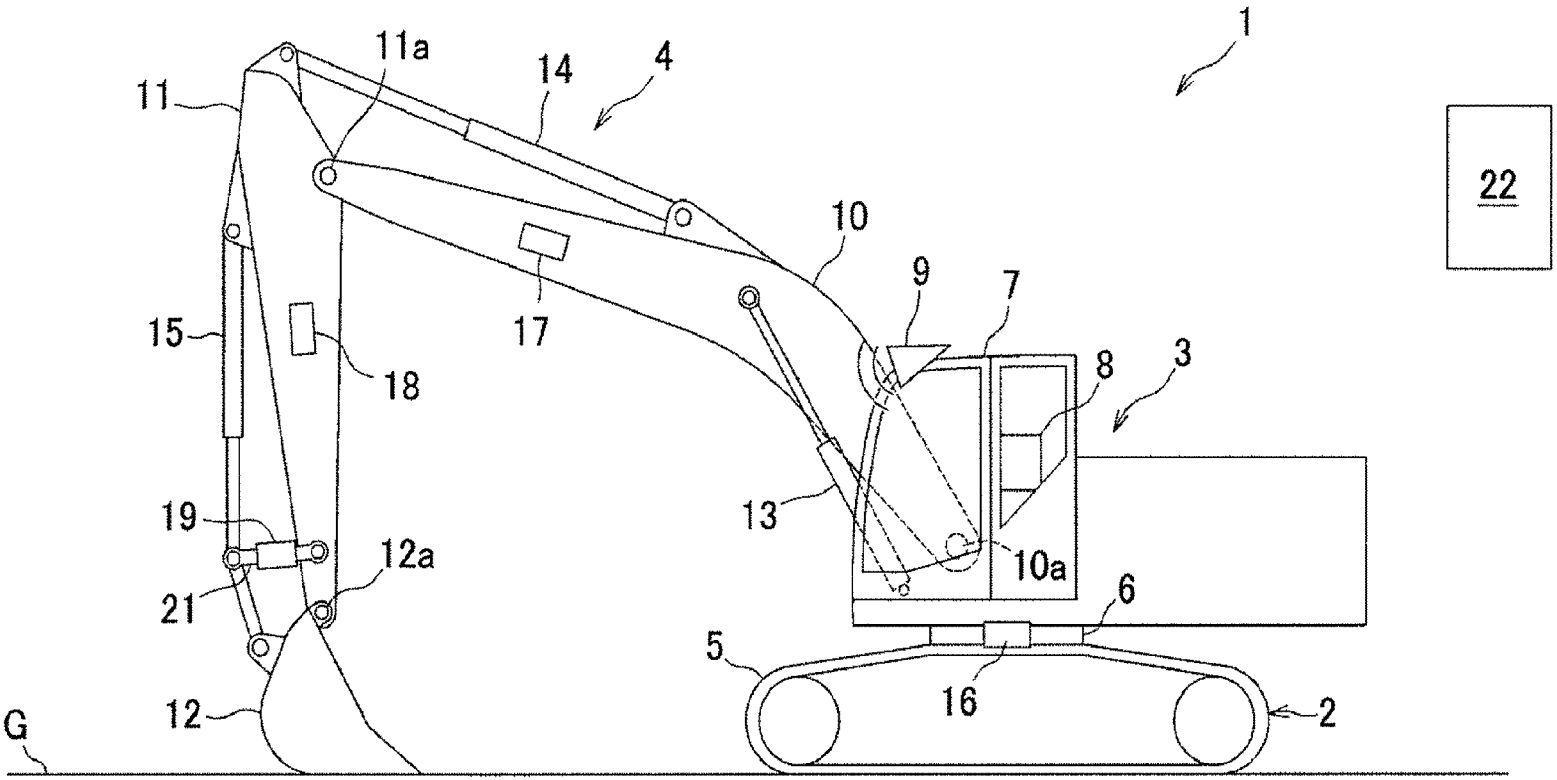
FIG. 1 is a side view of a hydraulic excavator which is an example of a working machine according to the present invention.

The hydraulic excavator 1 can excavate an excavation target having, for example, a mountain shape. As shown in FIG. 1, the hydraulic excavator 1 is a machine for performing a work with an attachment 4, and includes a lower traveling body 2, an upper slewing body 3 supported on the lower traveling body 2 slewably about a slewing axis extending in an up-down direction, and the attachment 4.

The lower traveling body 2 causes the hydraulic excavator 1 to travel, and has, for example, a crawler 5 travelable on the ground. The upper slewing body 3 is slewably attached onto the lower traveling body 2 via a slewing device 6. The upper slewing body 3 has a cab 7 serving as an operator compartment on a front portion thereof. The lower traveling body 2 and the upper slewing body 3 form a machine body of the present invention.

The attachment 4 is attached to the upper slewing body 3 in a tiltable manner (rotatably in the up-down direction). The attachment 4 includes a boom 10, an arm 11, and a bucket 12. The boom 10 has a proximal end attached to the upper slewing body 3. The arm 11 has a proximal end attached to a distal end of the boom 10. The bucket 12 is attached to a distal end of the arm 11. The bucket 12 serves as a leading end attachment to execute works including excavation, leveling, and scooping of an excavation target having a mountain shape, such as a soil and sand mound 100 (see FIG. 3A). Here, the bucket 12 is movable relative to the machine body.

The hydraulic excavator 1 further includes a boom cylinder 13, an arm cylinder 14, and a bucket cylinder 15 (drive section) respectively driving the boom 10, the arm 11, and the bucket 12. Each of the boom cylinder 13, the arm cylinder 14, and the bucket cylinder 15 is a hydraulic actuator. For instance, the boom cylinder 13 drives the boom 10 in a raising direction by extension and in a lowering direction by contraction. Each cylinder (drive section) can drive the bucket 12 relative to the upper slewing body 3.

The hydraulic excavator 1 further includes a slewing angle sensor 16, a boom angle sensor 17, an arm angle sensor 18, and a bucket angle sensor 19.

The slewing angle sensor 16 detects a slewing angle of the upper slewing body 3 to the lower traveling body 2. The slewing angle sensor 16 includes, for example, an encoder, a resolver, or a gyro sensor.

The boom angle sensor 17 is attached to the boom 10 to detect a posture of the boom 10. The boom angle sensor 17 acquires a tilt angle of the boom 10 to a horizontal line. For example, a tilt sensor or an acceleration sensor is adopted as the boom angle sensor 17. The boom angle sensor 17 may detect a rotation angle of a boom foot pin 10*a* (boom proximal end) to detect the posture of the boom 10. Alternatively, the boom angle sensor 17 may detect a stroke amount of the boom cylinder 13 to detect the posture of the boom 10.

The arm angle sensor 18 is attached to the arm 11 to detect a posture of the arm 11. The arm angle sensor 18 acquires a tilt angle of the arm 11 to a horizontal line. For example, a tilt sensor or an acceleration sensor is adopted as the arm angle sensor 18. The arm angle sensor 18 may detect a rotation angle of an arm connection pin 11*a* (arm proximal end) to detect the posture of the arm 11. Alternatively, the arm angle sensor 18 may detect a stroke amount of the arm cylinder 14 to detect the posture of the arm 11.

The bucket angle sensor 19 is attached to a link member 21 for driving the bucket 12 to detect a posture of the bucket 12. The bucket angle sensor 19 acquires a tilt angle of the bucket 12 to a horizontal line. For example, a tilt sensor or an acceleration sensor is adopted as the bucket angle sensor 19. The bucket angle sensor 19 may detect a rotation angle of a bucket connection pin 12*a* (bucket proximal end) to detect the posture of the bucket 12. Alternatively, the bucket angle sensor 19 may detect a stroke amount of the bucket cylinder 15 to detect the posture of the bucket 12.

A mobile terminal 22 shown in FIG. 1 is an external terminal manipulated by an operator or worker on a work site, and is, for example, a tablet terminal. The mobile terminal 22 is communicable with a controller 8 (start position determinator) to be described later. The mobile terminal 22 is arrangeable outside the hydraulic excavator 1 (at a position away from the hydraulic excavator 1). The mobile terminal 22 can form a part of the excavation position determination system according to the present invention.

A photographing device 9 is attached to the hydraulic excavator 1. Besides, the controller 8 is mounted on the hydraulic excavator 1. In the embodiment, the photographing device 9 is attached to the front of the upper slewing body 3. The controller 8 and the photographing device 9 form a part of the excavation position determination system according to the present invention.

The photographing device 9 photographs the soil and sand mound 100 (excavation target) and the bucket 12. Although the photographing device 9 is attached to the hydraulic excavator 1 in the embodiment, the photographing device 9 may not be attached to the hydraulic excavator 1. Specifically, the photographing device 9 may be arranged at such a position as to photograph the soil and sand mound 100, and the bucket 12, for example, in a periphery of the hydraulic excavator 1 or a periphery of a place where the soil and sand mound 100 is accumulated.

The photographing device 9 adopts, for example, a LIDAR, a laser radar, a millimeter-wave radar, or a stereo camera. The photographing device 9 may adopt a combination of the LIDAR and the camera.

The photographing device 9 can photograph various targets without limitation to the soil and sand mound 100 and the bucket 12.

Figure 2:
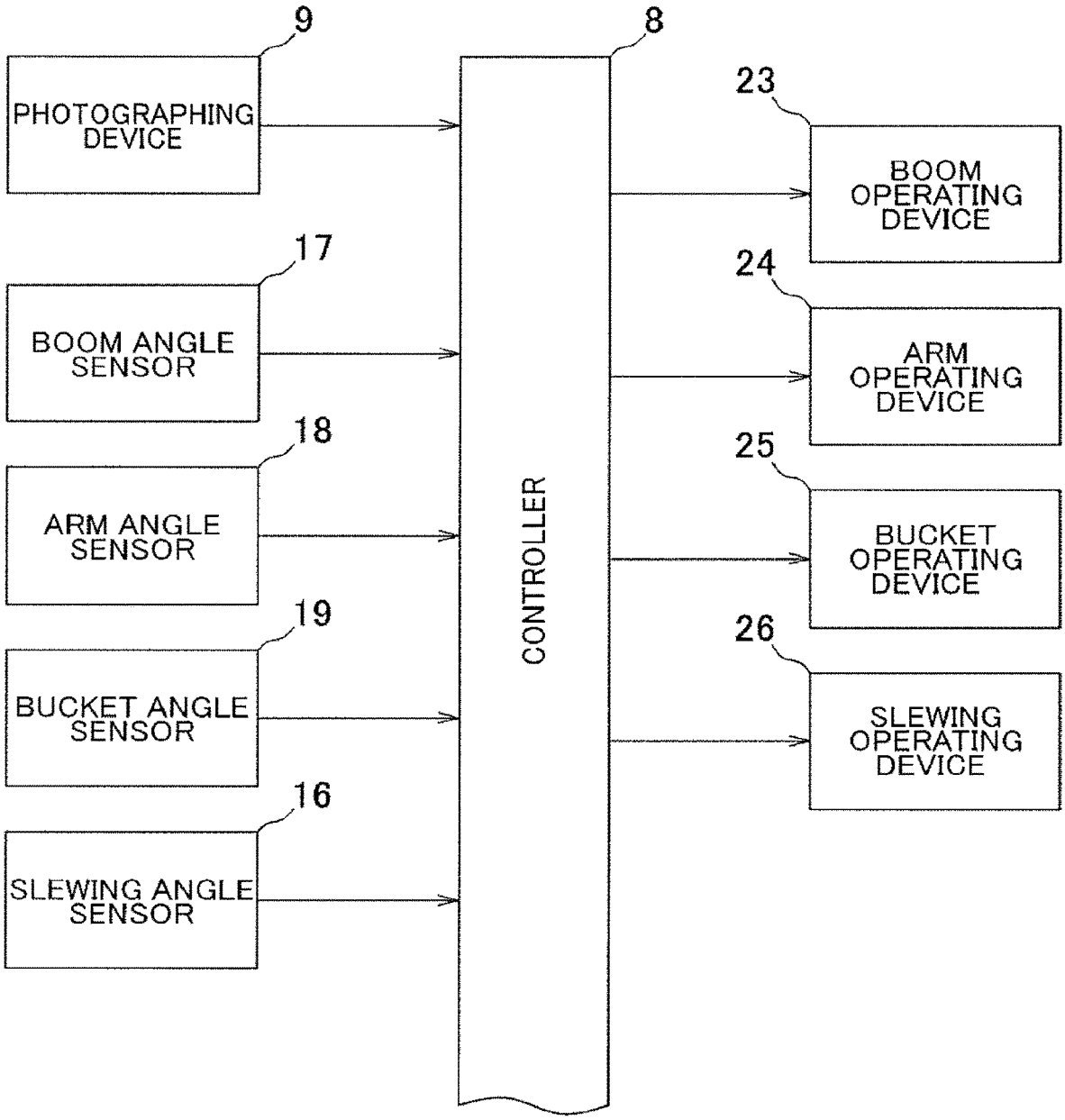
FIG. 2 is a block diagram showing a system including an excavation position determination system according to an embodiment of the present invention.

The controller 8 includes a computer which performs: input and output of a signal; computation including determination and calculation; and storage of information. As shown in FIG. 2, a signal from each of the photographing device 9, the boom angle sensor 17, the arm angle sensor 18, the bucket angle sensor 19, and the slewing angle sensor 16 is input to the controller 8. The controller 8 outputs a control signal to each of a boom operating device 23, an arm operating device 24, a bucket operating device 25, and a slewing operating device 26.

The boom operating device 23 controls the boom cylinder 13. The boom operating device 23 is, for example, a hydraulic control device, and includes a direction control valve, a pressure control valve, and a flow rate control valve.

The arm operating device 24 controls the arm cylinder 14. The arm operating device 24 is, for example, a hydraulic control device, and includes a direction control valve, a pressure control valve, and a flow rate control valve.

The bucket operating device 25 controls the bucket cylinder 15. The bucket operating device 25 is, for example, a hydraulic control device, and includes a direction control valve, a pressure control valve, and a flow rate control valve.

The slewing operating device 26 controls the slewing device 6. The slewing operating device 26 is, for example, a hydraulic control device, and includes a direction control valve, a pressure control valve, and a flow rate control valve.

The controller 8 (start position determinator) is configured to determine an excavation start position of the bucket 12 to the soil and sand mound 100. The excavation start position represents a reference point where the bucket 12 starts an excavation operation for the soil and sand mound 100, and, as an example, where the bucket 12 comes into contact with soil and sand of the soil and sand mound 100 from a state where the bucket 12 is arranged at an excavation start position when the boom 10 is driven in a lowering direction and the arm 11 is driven in a pulling direction. As described above, the excavation position determination system according to the present invention includes the photographing device 9 and the controller 8. The controller 8 (target specifying section) can specify the bucket 12, and the soil and sand mound 100 from photographed data of the photographing device 9.

Figure 3A:
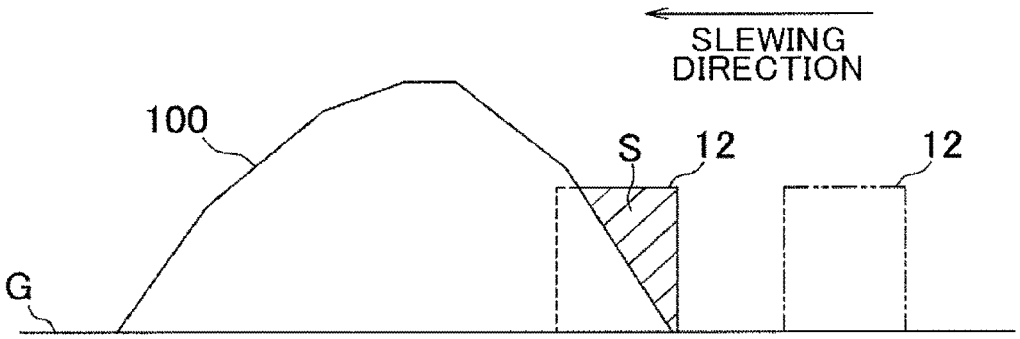
FIG. 3A is a diagram explaining a process of determining an excavation start position.

FIG. 3A is a diagram explaining a process of determining an excavation start position of the bucket 12. FIG. 3A is illustration obtainable when the soil and sand mound 100 is seen from the hydraulic excavator 1.

The controller 8 shifts the bucket 12 toward the soil and sand mound 100 in a slewing direction in the vicinity of ground G. The controller 8 causes the upper slewing body 3 to slew. The bucket 12 is positioned in the rear of the soil and sand mound 100 by the controller 8 when seen from the hydraulic excavator 1. Here, the controller 8 can calculate a position and a posture of the bucket 12 from a signal from each of the angle sensors 16 to 19. The controller 8 stores information about dimensions of respective members, i.e., the upper slewing body 3, the boom 10, the arm 11, and the bucket 12, in advance. The controller 8 controls the position and the posture of the bucket 12.

The controller 8 determines, on the basis of the detected data from the photographing device 9, a position of the bucket 12 where the bucket 12 is not wholly hidden by the soil and sand mound 100 but a part of the soil and sand mound 100 and a part of the bucket 12 overlap each other when the soil and sand mound 100 is seen from the hydraulic excavator 1 (machine body) as the excavation start position of the bucket 12 to the soil and sand mound 100. In other words, the excavation start position represents a position of the bucket 12 where one part of the bucket 12 is visible from the machine body and other part of the bucket 12 that is different from the one part is hidden by the soil and sand mound 100 when the bucket 12 is seen from the machine body.

In the example shown in FIG. 3A, the controller 8 determines a position of the bucket 12 where a proportion of an area S of a certain part (the one part) of the bucket 12 that does not overlap the soil and sand mound 100 to a whole area of the bucket 12 is a predetermined value (proportion) or lower when the soil and sand mound 100 is seen from the hydraulic excavator 1 as the excavation start position.

For instance, the controller 8 calculates the whole area of the bucket 12 from point group data (detected data) of the bucket 12 acquired by the photographing device 9 when the bucket 12 is not hidden by the soil and sand mound 100 (as the bucket 12 denoted by a double-dotted line in FIG. 3A). The predetermined value (proportion) indicates, for example, 30%.

When the bucket 12 is wholly hidden by the soil and sand mound 100, some soil and sand is left without being excavated. By contrast, excavation is failed when the soil and sand mound 100, and the bucket 12 do not overlap each other at all. The controller 8 (excavation position determination system) can automatically and appropriately determine an excavation start position in accordance with the shape or contour of the soil and sand mound 100. In a subsequent excavation, the soil and sand mound 100 is efficiently excavated without being left. Moreover, when the bucket 12 is wholly hidden by the soil and sand mound 100, a soil amount in the bucket 12 is undetectable in the excavation. The soil amount in the bucket 12 in the excavation is detectable by the photographing device 9 at an excavation position determined by the controller 8, and therefore, an unnecessary excavation operation is preventable and the soil and sand is efficiently excavated through a scooping operation by the bucket 12 when a given amount of soil and sand or more is excavated.

Furthermore, the controller 8 determines the excavation start position of the bucket 12 by employing the proportion of the area S of the certain part of the bucket 12 that does not overlap the soil and sand mound 100 to the whole area of the bucket 12, thereby reliably keeping the bucket 12 from being wholly hidden by the soil and sand mound 100 and preventing the bucket 12 and the soil and sand mound 100 from failing to overlap each other.

Here, the predetermined value (proportion) defined as, for example, 30% may be directly input to the controller 8 or may be input to the controller 8 through the mobile terminal 22, by the operator. Specifically, the operator may be allowed to correct the excavation start position by changing the predetermined value (proportion) through the mobile terminal 22. The operator allowed to correct the excavation start position through the mobile terminal 22 can flexibly set the excavation start position from a place away from the hydraulic excavator 1.

In addition, the controller 8 serves as a signal input section of the present invention as well. The signal input section inputs, to the drive section (each cylinder) of the hydraulic excavator 1, a drive instructive signal to start an excavation operation for the soil and sand mound 100 by the bucket 12 from an excavation start position determined by the controller 8 (start position determinator). In this case, the photographing device 9 and the controller 8 form an excavation control system according to the present invention.

Figure 3B:
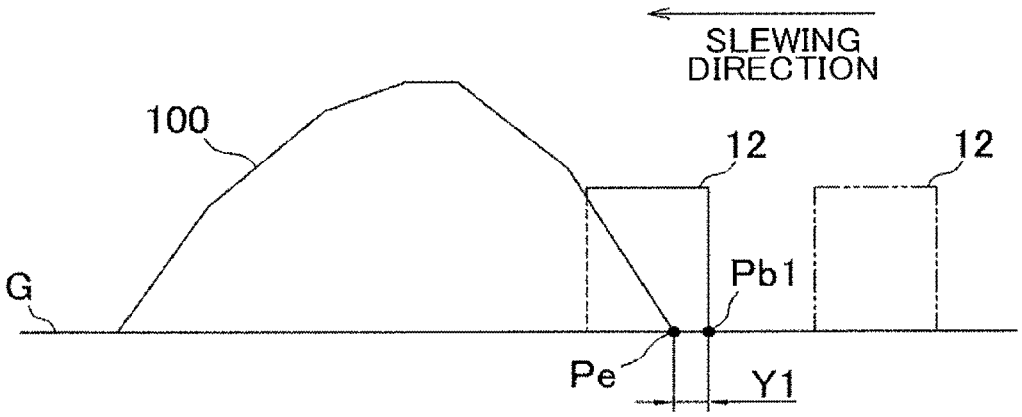
FIG. 3B is a diagram explaining another process of determining an excavation start position.

FIG. 3B is a diagram explaining another process, which is different from the process in FIG. 3A, of determining an excavation start position of the bucket 12. FIG. 3B is illustration obtainable when the soil and sand mound 100 is seen from the hydraulic excavator 1.

The controller 8 shifts the bucket 12 toward the soil and sand mound 100 in a slewing direction in the vicinity of the ground G. The controller 8 causes the upper slewing body 3 to slew. The bucket 12 is positioned in the rear of the soil and sand mound 100 by the controller 8.

The controller 8 determines a position of the bucket 12 where a distance Y1 (offset distance) between an end Pe of the soil and sand mound 100 that is closer to the bucket 12 in a direction of causing the bucket 12 to approach the soil and sand mound 100 and an end Pb1 of the bucket 12 in the opposite direction to the direction of causing the bucket 12 to approach the soil and sand mound 100 reaches a predetermined value (distance) or smaller when the soil and sand mound 100 is seen from the hydraulic excavator 1 as the excavation start position.

The end Pe is at a point on a lower corner which is closer to the bucket 12 among the point group data (detected data) of the soil and sand mound 100 acquired by the photographing device 9. The end Pb1 is at a point on a lower corner which is away from the soil and sand mound 100 among the point group data (detected data) of the bucket 12 acquired by the photographing device 9. The predetermined value (distance) indicates, for example, 200 mm.

Determination of the excavation start position of the bucket 12 by employing the distance Y1 (offset distance) between the end Pe of the soil and sand mound 100 that is closer to the bucket 12 in the direction of causing the bucket 12 to approach the soil and sand mound 100 and the end Pb1 of the bucket 12 in the opposite direction to the direction of causing the bucket 12 to approach the soil and sand mound 100 leads to a success in reliably keeping the bucket 12 from being wholly hidden by the soil and sand mound 100 and preventing the bucket 12 and the soil and sand mound 100 from failing to overlap each other.

Here, the predetermined value (distance) defined as, for example, 200 mm may be directly input to the controller 8 or may be input to the controller 8 through the mobile terminal 22, by the operator. Specifically, the excavation start position may be correctable in accordance with a change in the predetermined value (distance) through the mobile terminal 22. When the excavation start position is correctable through the mobile terminal 22, the operator can flexibly set an excavation start position from a place away from the hydraulic excavator 1.

In each of the cases shown in FIG. 3A and FIG. 3B, the controller 8 determines an excavation start position of the bucket 12 to the soil and sand mound 100 in a slewing direction of the upper slewing body 3 with respect to the lower traveling body 2.

Figure 4:
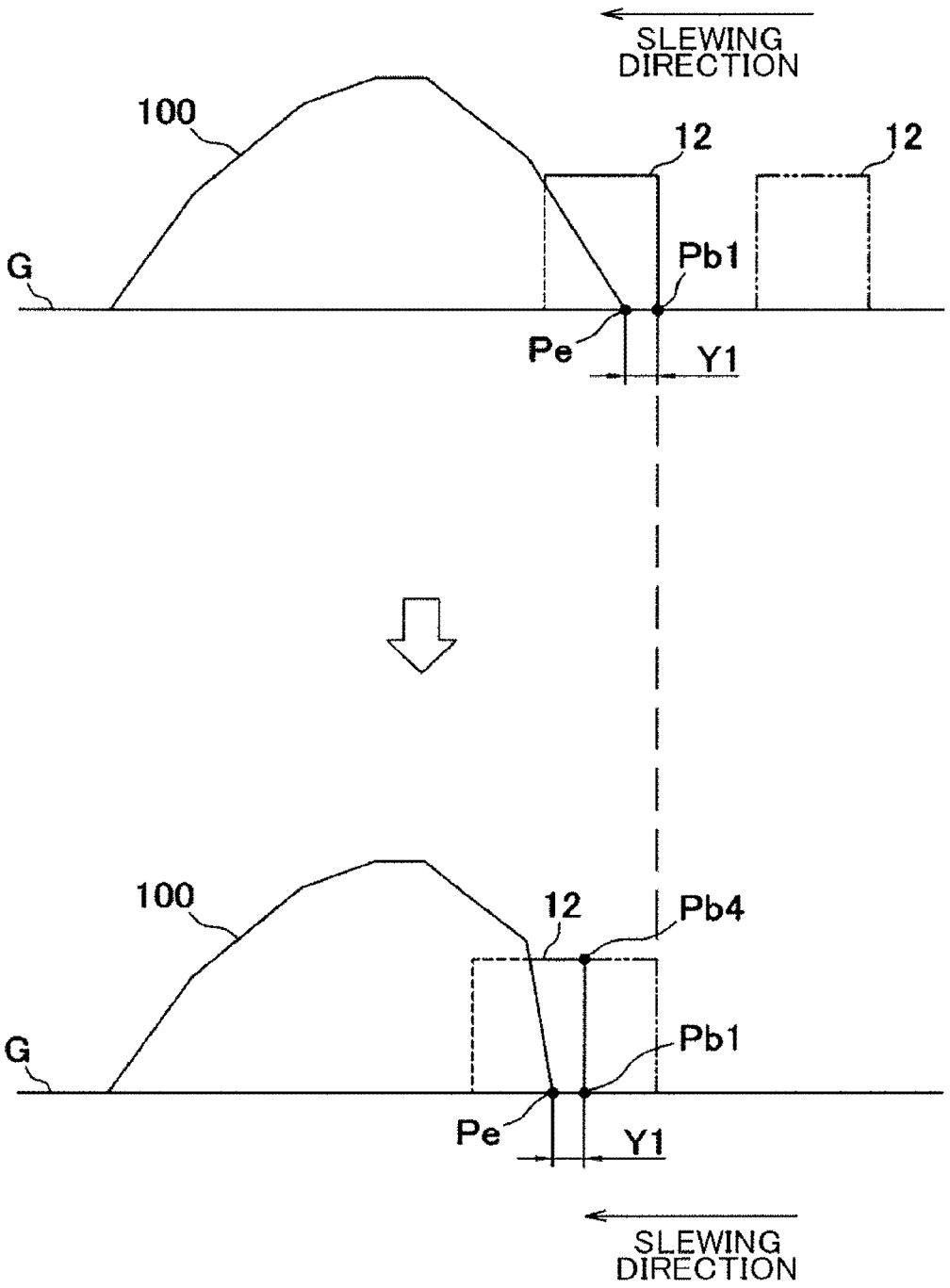
FIG. 4 is a diagram explaining a process of determining a first excavation start position and a second excavation start position.
Figure 5:
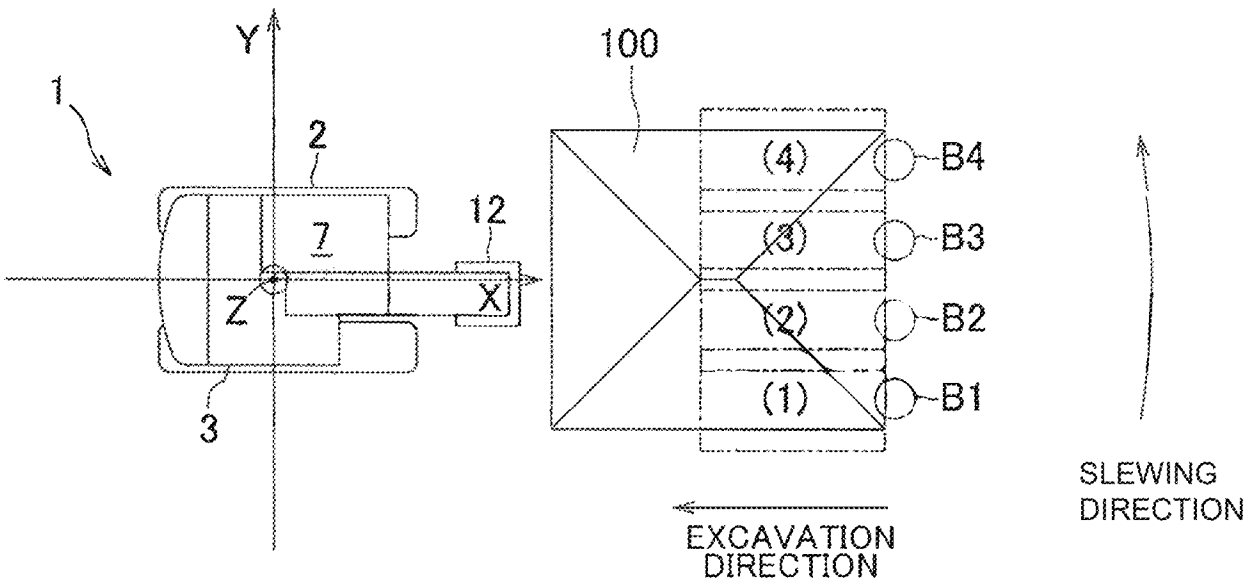
FIG. 5 is a plan view explaining a state of gradual deviation of excavation start positions from one another in a slewing direction.

FIG. 4 is a diagram explaining a process of determining a first excavation start position and a second excavation start position in gradual deviation of the bucket 12 from each other in the slewing direction at each excavation when the soil and sand mound 100 is excavated. FIG. 5 is a plan view explaining a state of gradual deviation of excavation start positions from one another in a slewing direction.

The upper illustration in FIG. 4 is equivalent to the illustration in FIG. 3B, but shows the first excavation start position of the bucket 12. The lower illustration in FIG. 4 shows the second excavation start position of the bucket 12.

In FIG. 5, the positions respectively denoted by the mark "○" and given the reference signs B1 to B4 represent first to fourth excavation start positions of the bucket 12. Double-dotted lined rectangle portions respectively denoted by the numerals (1) to (4) and adjacently overlapping each other in the slewing direction represent excavation ranges of the bucket 12 for first to fourth excavations. FIG. 5 further shows a three-dimensional rectangular coordinate system based on the hydraulic excavator 1. A direction of approaching the soil and sand mound 100 from the hydraulic excavator 1 is denoted by an X-axial direction (X-axis). A Y-axis is perpendicular to the X-axis on a horizontal plane, and a Z-axis is perpendicular to both the X-axis and the Y-axis. The Z-axis extends in a vertical direction.

In the example shown in FIG. 4, a way of determining the first excavation start position of the bucket 12 is the same as a way of determining the second excavation start position of the bucket 12.

Specifically, the controller 8 shifts the bucket 12 toward the soil and sand mound 100 in the slewing direction in the vicinity of the ground G. The controller 8 determines, on the basis of the detected data from the photographing device 9, a position of the bucket 12 where of the bucket 12 is not wholly hidden by the soil and sand mound 100 but a part of the soil and sand mound 100 and a part of the bucket 12 overlap each other as the first excavation start position of the bucket 12 to the soil and sand mound 100 (upper illustration in FIG. 4).

Similarly, the controller 8 determines, on the basis of the detected data from the photographing device 9, each of the second and subsequent excavation start position (lower illustration in FIG. 4) so that the bucket 12 is not wholly hidden by the soil and sand mound 100 but a part of the soil and sand mound 100 and a part of the bucket 12 overlap each other.

That is to say, the controller 8 determines a position of the bucket 12 where one part of the bucket 12 is visible from the machine body and other part of the bucket 12 is hidden by the soil and sand mound 100 as the excavation start position in each of the first and second excavations. Here, the controller 8 deviates each of the second and subsequent excavation start positions from a preceding excavation start position in the slewing direction (Y-axial direction) of the bucket 12.

The shape or contour of the soil and sand mound 100 changes every moment in accordance with an excavation situation thereof. This configuration enables automatic and appropriate determination of the excavation start position in accordance with the shape or contour of the soil and sand mound 100 in the second or subsequent excavation in addition to the first excavation.

Concerning determination of the excavation start position of the bucket 12, in the examples shown in FIG. 4 and FIG. 5, the controller 8 determines each of the first excavation start position, and second and subsequent excavation start positions of the bucket 12 by employing a distance Y1 (offset distance) between an end Pe of the soil and sand mound 100 that is closer to the bucket 12 in the direction of causing the bucket 12 to approach the soil and sand mound 100 and an end Pb1 of the bucket 12 in the opposite direction to the direction of causing the bucket 12 to approach the soil and sand mound 100 in the same manner as shown in FIG. 3B.

Alternatively, as shown in FIG. 3A, the controller 8 may determine each excavation start position of the bucket 12 by employing a proportion of an area S of a certain part of the bucket 12 that does not overlap the soil and sand mound 100 to the whole area of the bucket 12.

The end Pb1 is at a point on a lower corner which is away from the soil and sand mound 100 among point group data (detected data) of the bucket 12 acquired by the photographing device 9. The end Pb1 may be undetectable due to the soil and sand accumulated on the ground G. In this case, the controller 8 can calculate a coordinate of the end Pb 1 from an end Pb4 located above the end Pb1 and on an upper corner of the bucket 12 by using the dimension of the bucket 12 stored in the controller 8.

Moreover, concerning the determination of each of the second and subsequent excavation start positions, the controller 8 may deviate the second and subsequent excavation start positions from one another each at a predetermined angle in the slewing direction of the bucket 12 per excavation. This predetermined angle takes a fixed value determined and input to the controller 8 by the operator without consideration of the detected data from the photographing device 9. Even with the fixed value, the bucket 12 can be kept from being wholly hidden by the soil and sand mound 100. Consequently, the soil and sand mound 100 is efficiently excavatable in a subsequent excavation. Further, a computation load of the controller 8 is suppressible.

The controller 8 controls the boom 10, the arm 11, and the bucket 12 to execute the first excavation after determining a first excavation start position B1 (see FIG. 5). After the first excavation and soil discharge is finished, the bucket 12 is shifted in the slewing direction for determination of a second excavation start position B2, and the second excavation is executed. The controller 8 gradually deviates each excavation start position in the slewing direction per excavation. FIG. 5 is a plan view explaining a state of gradual deviation of excavation start positions from one another in the slewing direction. The excavation direction is represented by the X-axial direction in FIG. 5, but, more accurately, the excavation direction indicates a direction of approaching the proximal end of the boom 10 of the hydraulic excavator 1.

Figure 6:
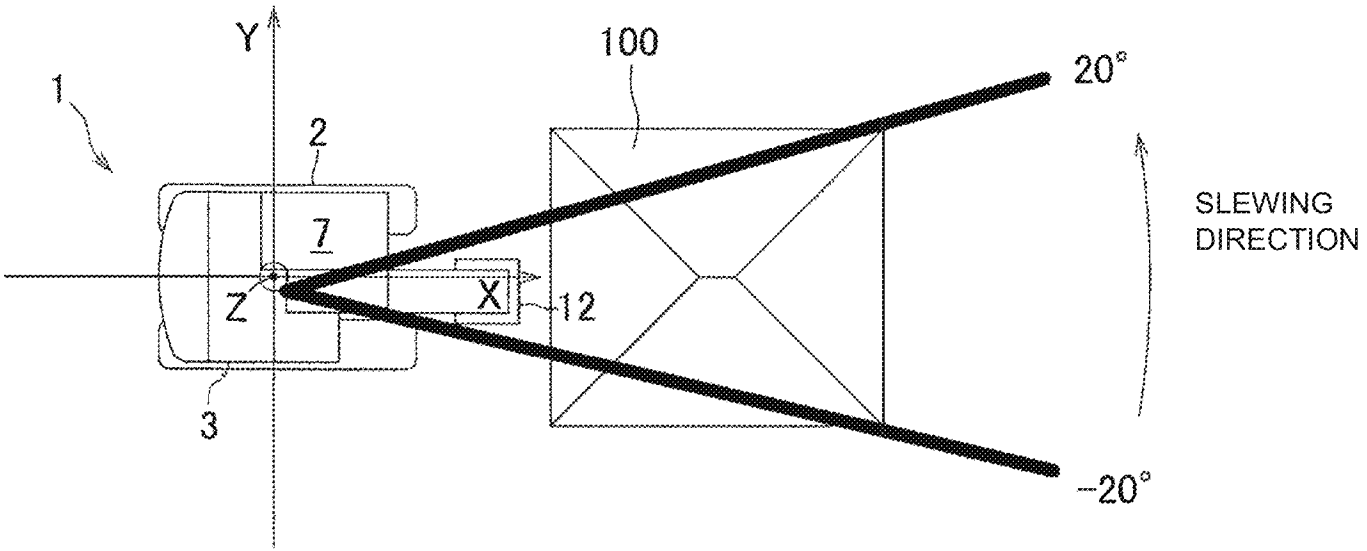
FIG. 6 is a plan view explaining a state of gradual deviation of excavation start positions from one another in the slewing direction.
Figure 7:
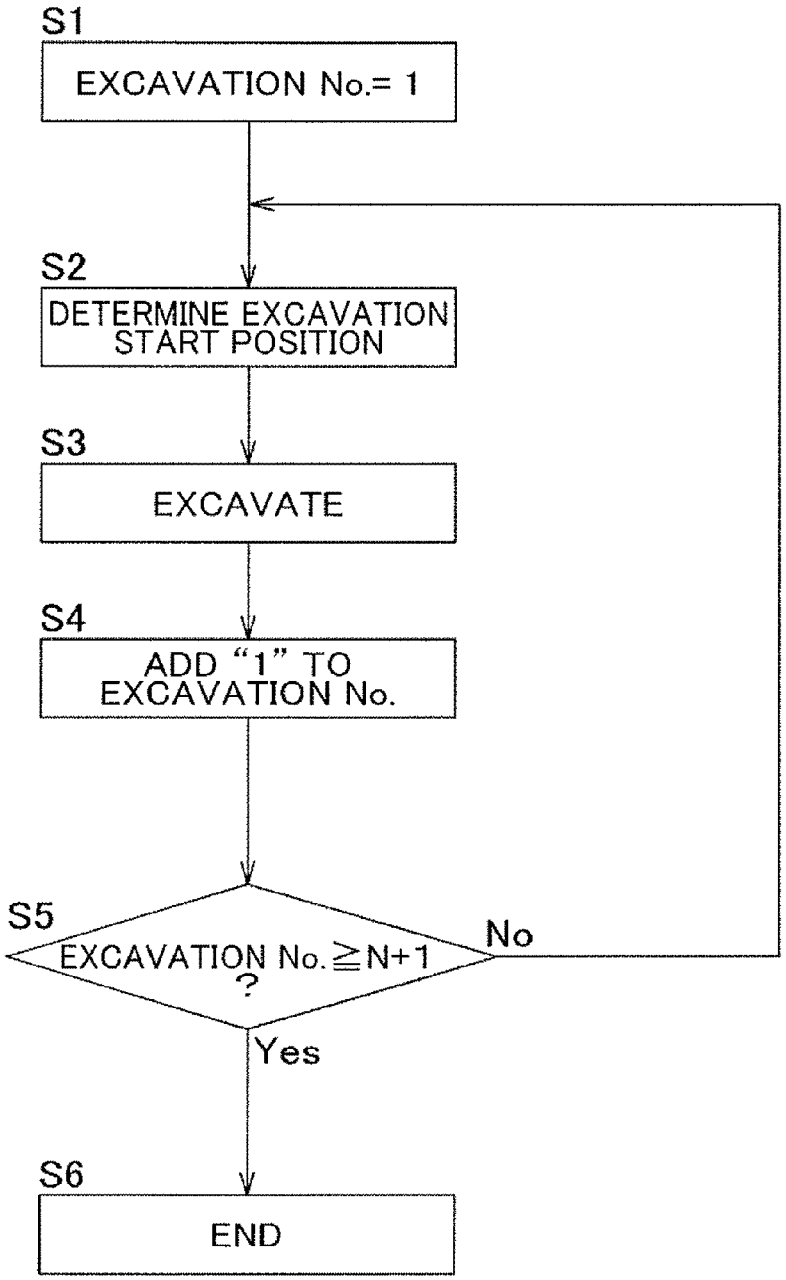
FIG. 7 is a flowchart explaining a flow of executions of counting an excavation number by the controller and changing the excavation start position by the controller in accordance with the excavation number, i.e., excavation No.

FIG. 6 is a plan view explaining a state of gradual deviation of excavation start positions from one another in a slewing direction. FIG. 7 is a flowchart explaining a flow of executions of counting an excavation number, i.e., excavation No., and changing, in accordance with the excavation No, the excavation start position by the controller 8.

As shown in FIG. 6, for example, a whole excavation range of the soil and sand mound 100 in the slewing direction is presumed as a range of −20° to 20° in a view from the hydraulic excavator 1.

The controller 8 may deviate the second and subsequent excavation start positions in the slewing direction of the bucket 12 in accordance with the excavation number input by the controller 8.

Here, it is presumed that a specific excavation number, for instance, "5" is input as the excavation number "N" to the controller 8 as to how many excavations are required to excavate a whole range (whole excavation range) of the soil and sand mound 100 in the slewing direction. That is to say, the whole range of the soil and sand mound 100 in the slewing direction is supposed to be excavatable at five excavations in total.

As shown in FIG. 7, the controller 8 determines the excavation number as "1", i.e., excavation No.=1 (corresponding to step 1 as denoted by "S1" in FIG. 1, and the same expression is adopted for other steps).

The controller 8 shifts the bucket 12 toward the soil and sand mound 100 in the slewing direction. The controller 8 determines, on the basis of the detected data from the photographing device 9, a position of the bucket 12 where the bucket 12 is not wholly hidden by the soil and sand mound 100 but a part of the soil and sand mound 100 and a part of the bucket 12 overlap each other as the first excavation start position of the bucket 12 to the soil and sand mound 100 (step S2).

Subsequently, the controller 8 controls the boom 10, the arm 11, and the bucket 12 to excavate the soil and sand mound 100 (step S3).

Next, the controller 8 adds "1" to the excavation No. (step S4), and returns to step S2 when the excavation No. does not exceed "5" (No in step S5). Contrarily, when the excavation No. exceeds "5", that is, indicates N 1 or larger (Yes in step S5), the controller 8 decides an end of excavation (step S6), and thus the excavation is finished.

In this regard, the second and subsequent excavation start positions are determined, for example, in the manner described below. The controller 8 equally divides, in the slewing direction, a residual range that is left from the whole excavation range (−20° to 20°) of the soil and sand mound 100 after the first excavation, and gradually deviates excavation start positions at equal intervals (each at a predetermined angle or an equal phase difference) in the second and subsequent excavations. In other words, the controller 8 equally divides the range left after the first excavation by the remaining excavation number=4 in the slewing direction.

Here, the operator may determine the excavation number under the condition that a part of an excavation range of the bucket in an n-th excavation and a part of an excavation range of the bucket in an (n+1)th excavation overlap each other, and the operator may input the determined excavation number to the controller 8. Specifically, the controller 8 can receive an input of the excavation number to the soil and sand mound 100, and can set the predetermined angle in accordance with the input excavation number so that the second and subsequent excavation start positions shift in the slewing direction.

The operator may input another excavation number to the controller 8 to change the excavation number, that is, to comet the excavation start position. Here, the operator may input the excavation number from the mobile terminal 22 to the controller 8. Specifically, the excavation start position may be correctable through the mobile terminal 22 in accordance with the changed excavation number. In this case, the mobile terminal 22 is operable to input, to the controller 8, a signal of correcting the excavation start position.

As described heretofore, the controller 8 enabling deviation of the excavation start positions in the slewing direction of the bucket 12 in accordance with the input excavation number allows the operator to input another excavation number to the controller 8 in accordance with the shape or contour of the soil and sand mound 100 to change the excavation number, and consequently permits the hydraulic excavator 1 to flexibly execute an excavation in accordance with the shape or contour of the soil and sand mound 100.

Figure 8A:
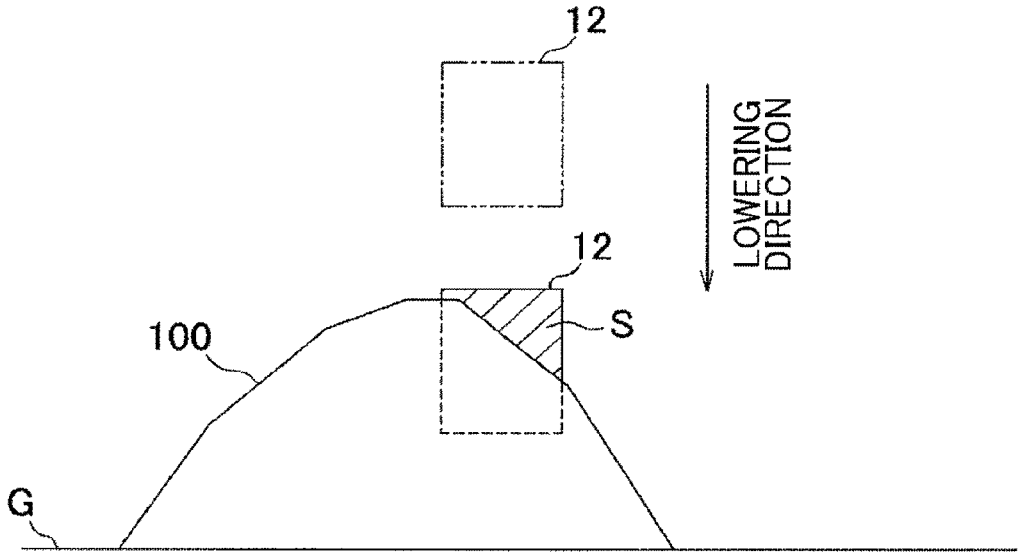
FIG. 8A is a diagram explaining a process of determining an excavation start position in a modification.

FIG. 8A is a diagram explaining a process of determining an excavation start position in a modification in the present invention.

The example in FIG. 3A illustrates a state where the controller 8 shifts the bucket 12 toward the soil and sand mound 100 in the slewing direction in the vicinity of the ground G. By contrast, in the example shown in FIG. 8, a controller 8 lowers a bucket 12 from a position above a soil and sand mound 100 to a rear position of the soil and sand mound 100 to arrange the bucket 12 at an excavation start position. In this case, the controller 8 moves an arm 11 in a lowering direction.

The controller 8 determines, on the basis of detected data from a photographing device 9, a position of the bucket 12 where a proportion of an area S of a specific part of the bucket 12 that does not overlap the soil and sand mound 100 to a whole area of the bucket 12 is a predetermined value (proportion) or lower when the soil and sand mound 100 is seen from the hydraulic excavator 1 as the excavation start position.

The predetermined value (proportion) indicates, for example, 30%. Here, the controller 8 deviates the second and subsequent excavation start positions downward from a preceding excavation start position.

Figure 8B:
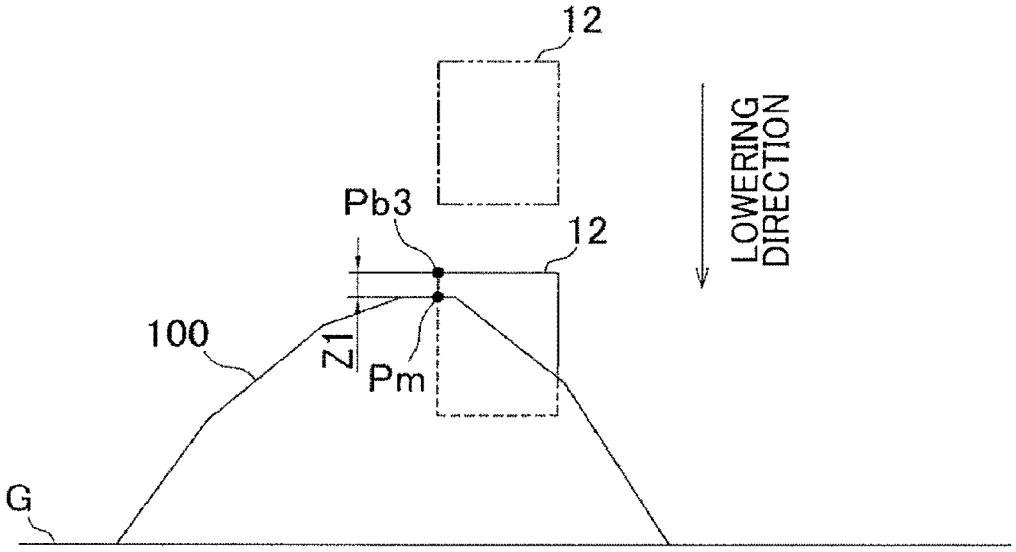
FIG. 8B is a diagram explaining a process of determining an excavation start position in another modification.

FIG. 8B is a diagram explaining another process, which is different from the process in FIG. 8A, of determining an excavation start position in another modification in the present invention.

The example in FIG. 3B illustrates a state where the controller 8 shifts the bucket 12 toward the soil and sand mound 100 in the slewing direction in the vicinity of the ground G. By contrast, in the example shown in FIG. 8B, a controller 8 lowers a bucket 12 from a position above a soil and sand mound 100 to a rear position of the soil and sand mound 100 to arrange the bucket 12 at an excavation start position. In this case, the controller 8 moves an arm 11 in a lowering direction.

The controller 8 determines, on the basis of detected data from a photographing device 9, a position of the bucket 12 where a distance Z1 (offset distance) between an end Pm of the soil and sand mound 100 that is closer to the bucket 12 in a direction of causing the bucket 12 to approach the soil and sand mound 100 and an end Pb3 of the bucket 12 in the opposite direction to the direction of causing the bucket 12 to approach the soil and sand mound 100 reaches a predetermined value (distance) or smaller when the soil and sand mound 100 (bucket 12) is seen from the hydraulic excavator 1 (machine body) as the excavation start position.

The predetermined value (distance) indicates, for example, 200 mm. Here, the controller 8 deviates the second and subsequent excavation start positions downward from a preceding excavation start position.

In each of the cases shown in FIG. 8A and FIG. 8B, the controller 8 determines the excavation start position of the bucket 12 to the soil and sand mound 100 in a tilting direction of the attachment 4 with respect to the upper slewing body 3.

Heretofore, the embodiment and modifications of the present invention are described. Here, the embodiment and the modifications are further changeable in the manner described below.

The excavation target having the mountain shape may be a crushed stone mound, a scrap mound, or a rubber mound in place of the soil and sand mound 100.

FIG. 3A and other drawings show that the bucket 12 is shifted toward the soil and sand mound 100 in the slewing direction in the vicinity of the ground G to determine an excavation start position of the bucket 12 to the soil and sand mound 100. Alternatively, the bucket 12 may be arranged at a position above the ground G without exceeding the height of the top of soil and sand mound 100, and the bucket 12 may be shifted from the position toward the soil and sand mound 100 in the slewing direction to determine the excavation start position of the bucket 12 to the soil and sand mound 100.

The controller 8 mounted on the hydraulic excavator 1 does not necessarily store a computation system for determining an excavation start position of the bucket 12 to the soil and sand mound 100. For instance, another controller (not shown) which is different from the controller 8 but communicable with the controller 8, and further provided outside the hydraulic excavator 1 may store a computation system for determining an excavation start position of the bucket 12 to the soil and sand mound 100.

Heretofore, the embodiment of the present invention is described. In addition, various changes are applicable to an extent conceivable by a person skilled in the art. The hydraulic excavator 1 (working machine) does not need to include all the components of each of the excavation position determination system and the excavation control system according to the present invention. For instance, a server provided in a remote management center located at a position away from a work site of the hydraulic excavator 1 may serve as the controller 8.

The present invention provides an excavation position determination system for use in a working machine including a machine body and a bucket movable relative to the machine body for excavating an excavation target having a mountain shape. The excavation position determination system includes: a photographing device that photographs the excavation target and the bucket; and a start position determinator that determines an excavation start position of the bucket to the excavation target. The start position determinator determines, on the basis of detected data from the photographing device, a position of the bucket where one part of the bucket is visible from the machine body and other part of the bucket that is different from the one part is hidden by the excavation target when the bucket is seen from the machine body as the excavation start position.

In the configuration, the start position determinator may determine a position of the bucket where a proportion of an area of the one part of the bucket visible from the machine body to a whole area of the bucket is a predetermined value or lower when the bucket is seen from the machine body as the excavation start position.

In the configuration, the start position determinator may determine a position of the bucket where a distance between an end of the excavation target that is closer to the bucket in a direction of causing the bucket to approach the excavation target and an end of the bucket in the opposite direction to the direction of causing the bucket to approach the excavation target reaches a predetermined value or smaller when the bucket is seen from the machine body as the excavation start position.

In the configuration, when the working machine executes a plurality excavation works to the excavation target, the start position determinator may determine a position of the bucket where one part of the bucket is visible from the machine body and the other part of the bucket is hidden by the excavation target as a first excavation start position, and determine a position of the bucket where one part of the bucket is visible from the machine body and the other part of the bucket is hidden by the excavation target as a second or subsequent excavation start positions.

In the configuration, when the working machine executes a plurality of excavation works to the excavation target, the start position determinator may determine a position of the bucket where the one part of the bucket is visible from the machine body and the other part of the bucket is hidden by the excavation target as a first excavation start position, and determine second and subsequent excavation start positions in deviation from one another each at a predetermined angle.

In the configuration, the start position determinator may be configured to receive an input of an excavation number to the excavation target and set the predetermined angle in accordance with the input excavation number so that the second and subsequent excavation start positions shift in a slewing direction.

The configuration may further include an external terminal arrangeable at a position away from the working machine and communicable with the start position determinator. The external terminal may be operable to input, to the start position determinator, a signal of correcting the excavation start position.

The present invention provides an excavation control system including: the excavation position determination system described above; and a signal input section that inputs a drive instructive signal to the working machine to start an excavation operation for the excavation target by the bucket from the excavation start position determined by the start position determinator of the excavation position determination system.

In addition, the present invention provides a working machine including: a machine body; a bucket that is movable relative to the machine body; a drive section that drives the bucket; and the excavation control system described above. The signal input section inputs the drive instructive signal to the drive section to start the excavation operation for the excavation target by the bucket from the excavation start position determined by the start position determinator of the excavation position determination system.

In the configuration, the machine body may include: a lower traveling body; an upper slewing body supported on the lower traveling body slewably about a slewing axis extending in an up-down direction; and an attachment including the bucket and tiltably supported on the upper slewing body. The start position determinator may determine the excavation start position of the bucket to the excavation target in a slewing direction of the upper slewing body with respect to the lower traveling body.

In the configuration, the machine body may include: a lower traveling body; an upper slewing body supported on the lower traveling body slewably about a slewing axis extending in an up-down direction; and an attachment including the bucket and tiltably supported on the upper slewing body. The start position determinator may determine the excavation start position of the bucket to the excavation target in a tilting direction of the attachment with respect to the upper slewing body.

The invention claimed is:

1. An excavation position determination system for use in a working machine including a machine body and a bucket movable relative to the machine body for excavating an excavation target having a mountain shape, the excavation position determination system comprising:

a photographing device that photographs the excavation target and the bucket, detected data from the photographing device includes a photograph of a whole area of the bucket that is seen from the machine body, the photographing device including a LIDAR, a laser radar, a millimeter-wave radar, or a stereo camera; and a controller that determines an excavation start position of the bucket to the excavation target, wherein the controller determines, on the basis of the detected data from the photographing device, a position of the bucket where a first part of the whole area of the bucket is visible from the machine body and a second part of the whole area of the bucket is hidden by the excavation target when the bucket is seen from the machine body as the excavation start position, the excavation start position being a position where the bucket is positioned to a rear of the excavation target when seen from the machine body, the controller controls the bucket to start an excavation operation for the excavation target by the bucket from the excavation start position.

2. The excavation position determination system according to claim 1, wherein the controller determines a position of the bucket where a proportion of an area of the first part of the bucket visible from the machine body to the whole area of the bucket is a predetermined value or lower when the bucket is seen from the machine body as the excavation start position.

3. The excavation position determination system according to claim 1, wherein the controller determines a position of the bucket where a distance between an end of the excavation target that is closer to the bucket in a direction of causing the bucket to approach the excavation target and an end of the bucket in the opposite direction to the direction of causing the bucket to approach the excavation target reaches a predetermined value or smaller when the bucket is seen from the machine body as the excavation start position.

4. The excavation position determination system according to claim 1, wherein, when the working machine executes a plurality excavation works to the excavation target, the controller determines, for each excavation work of the plurality of excavation works, the position of the bucket where the first part of the bucket is visible from the machine body and the second part of the bucket is hidden by the excavation target as the excavation start position.

5. The excavation position determination system according to claim 1, wherein, when the working machine executes a plurality of excavation works to the excavation target, the controller determines the position of the bucket where the first part of the bucket is visible from the machine body and the second part of the bucket is hidden by the excavation target as a first excavation start position, and determines second and subsequent excavation start positions in deviation from one another each at a predetermined angle.

6. The excavation position determination system according to claim 5, wherein the controller is configured to receive an input of an excavation number to the excavation target and set the predetermined angle in accordance with the input excavation number so that the second and subsequent excavation start positions shift in a slewing direction.

7. The excavation position determination system according to claim 1, further comprising an external terminal arrangeable at a position away from the working machine and communicable with the controller, wherein the external terminal is operable to input, to the controller, a signal of correcting the excavation start position.

8. An excavation control system comprising:

the excavation position determination system according to claim 1; and a signal input section that inputs a drive instructive signal to the working machine to start an excavation operation for the excavation target by the bucket from the excavation start position determined by the controller of the excavation position determination system.

9. A working machine comprising:

a machine body;

a bucket that is movable relative to the machine body;

a drive section that drives the bucket; and the excavation control system according to claim 8, wherein the signal input section inputs the drive instructive signal to the drive section to start the excavation operation for the excavation target by the bucket from the excavation start position determined by the controller of the excavation position determination system.

10. The working machine according to claim 9, wherein the machine body includes:

a lower traveling body;

an upper slewing body supported on the lower traveling body slewably about a slewing axis extending in an up-down direction; and an attachment including the bucket and tiltably supported on the upper slewing body, wherein the controller determines the excavation start position of the bucket to the excavation target in a slewing direction of the upper slewing body with respect to the lower traveling body.

11. The working machine according to claim 9, wherein the machine body includes:

a lower traveling body;

an upper slewing body supported on the lower traveling body slewably about a slewing axis extending in an up-down direction; and an attachment including the bucket and tiltably supported on the upper slewing body, wherein the determinater controller determines the excavation start position of the bucket to the excavation target in a tilting direction of the attachment with respect to the upper slewing body.

* * * * *